US005896457A

United States Patent [19]

Tyrrel

[11] Patent Number: 5,896,457

[45] Date of Patent: Apr. 20, 1999

[54] LIGHT ENHANCED SOUND DEVICE AND METHOD

[75] Inventor: Sylvan F. Tyrrel, 18333 Roehampton Dr. #227, Dallas, Collin County, Tex. 75252

[73] Assignees: Sylvan F. Tyrrel, Plano; Dehryll W. Galloway, Dallas, both of Tex.

[21] Appl. No.: 08/716,129

[22] Filed: Sep. 20, 1996

[51] Int. Cl.[6] ..... H04R 29/00

[52] U.S. Cl. ..... 381/56; 84/464 R

[58] Field of Search ..... 381/25, 56, 61, 381/300; 84/464 R; 600/207

[56] References Cited

U.S. PATENT DOCUMENTS

| | | | |
|---|---|---|---|
| 4,081,829 | 3/1978 | Brown | 381/56 |
| 4,315,502 | 2/1982 | Gorges | 128/1 C |
| 5,036,858 | 8/1991 | Carter et al. | 128/732 |
| 5,149,317 | 9/1992 | Robinson | 600/27 |
| 5,242,376 | 9/1993 | Shealy et al. | 600/27 |
| 5,259,830 | 11/1993 | Masuda | 600/27 |
| 5,304,112 | 4/1994 | Mrklas et al. | 600/27 |
| 5,306,228 | 4/1994 | Rubins | 600/27 |
| 5,403,261 | 4/1995 | Shimizu et al. | 600/27 |
| 5,409,445 | 4/1995 | Rubins | 600/27 |
| 5,501,131 | 3/1996 | Hata | 84/464 R |

*Primary Examiner*—Vivian Chang
*Attorney, Agent, or Firm*—Baker & McKenzie

[57] ABSTRACT

A device (10) for producing light enhanced sound from a music source (36) producing music signals on at least a first (54) and second (56) channel is provided. The device (10) includes a speaker (18 or 20) for reproducing music from the music signals. The device (10) also includes axis-crossing detection circuitry (69) coupled to the first (54) and second (56) channels that detects when the music signal on each channel crosses the time-axis and generates an axis-crossing signal. The present device (10) further includes light control circuitry (81) coupled to the axis-detecting circuitry (69) operable to generate a light signal responsive to the axis crossing signals. The present device (10) also includes a light (42) coupled to the light control circuitry (81). The light (42) is illuminated responsive to the light signal.

47 Claims, 4 Drawing Sheets

LIGHT ENHANCED SOUND DEVICE AND METHOD

TECHNICAL FIELD OF THE INVENTION

This invention relates in general to the field of entertainment devices, and more particularly to a device and method for providing light enhanced sound.

BACKGROUND OF THE INVENTION

Devices have been previously developed to induce relaxation and relieve stress by providing combinations of light and sound. One such device drives optical sensors to provide light at specific brainwave frequencies while simultaneously providing musical signals, e.g., voice or instrumental music. Such systems employ a forcing function that seeks to alter a user's brainwave to a dominant predetermined frequency, usually defined in the well-known beta, alpha, theta, or delta states. Such systems attempt to modify brainwaves to induce feelings of relaxation in the user.

Another prior device modulates each sound channel of a stereophonic musical signal with a rectangular wave at the desired brainwave frequency to provide a similar effect. Using this device with the eyes closed, light signals are viewed that produce ideas of time and space as well as nonproducable or chaotic effects. Such systems produce limited lighting effects because the light they produce is driven by a constant rectangular wave.

Additionally, other previously developed relaxation devices provide light that is dependent on the amplitude of a musical signal. Again, such systems are limited in the variations of light emissions they are capable of providing. These prior devices do not provide appropriate stimulation to modify brainwaves and induce a user's sense of relaxation or provide acceptable entertainment value to the user. To the contrary, such prior devices may induce a sense of confusion in the user. Confusion that is similar to a trance but is more related to the operation of the brain cross-correlating information from both audio and visual senses. Confusion occurs when listening to music when one ear hears a musical signal at one frequency while the other ear hears a musical signal at a different frequency.

SUMMARY OF THE INVENTION

Therefore a need has arisen for a device and method for providing light enhanced sound.

In accordance with the present invention, a light enhanced sound device and method are provided that substantially eliminate or reduce disadvantages and problems associated with previously developed relaxation and entertainment devices.

One aspect of the present invention provides a device for producing light enhanced sound from a music source producing music signals on at least a first and second channel. The device includes a speaker for reproducing music from the music signals. The device also includes axis-crossing detection circuitry coupled to the first and second channels that detects when the music signal on each channel crosses the time-axis and generates an axis-crossing signal. The present device further includes light control circuitry coupled to the axis-detecting circuitry operable to generate a light signal responsive to the axis crossing signals and a light coupled to the light control circuitry. The light is illuminated responsive to the light signal.

Another aspect of the present invention provides a device for producing light enhanced sound from a music source producing music signals on at least a first and second channel. This embodiment of the present invention includes a headset having a speaker for reproducing music from the music signals. The headset also includes axis-crossing detection circuitry coupled to the first and second channels for detecting when the music signal on each channel crosses the time-axis and for generating an axis-crossing signal. The headset further includes light control circuitry coupled to the axis-crossing detection circuitry operable to generate a light signal responsive to the axis crossing signals. The present invention also includes a visor coupled to the headset including a light coupled to the light control circuitry. The light is illuminated responsive to the light signal.

Yet another aspect of the present invention provides a method for generating light enhanced sound from a music source producing music signals on at least a first and second channel. The method includes reproducing music from the music signals at a first speaker. The present method also includes detecting when the music signal on each channel crosses the time-axis and generating an axis-crossing signal the present method further includes generating a light signal responsive to the axis-crossing signals. The present method also includes illuminating a light in response to the light signal.

An additional aspect of the present invention provides a device for producing light enhanced sound from digital musical signals on at least a first and second channel. The device includes circuitry for reading the most significant bit (MSB) in each channel. The device further includes a modulator for comparing the MSB from each channel and for generating a light control signal responsive to the comparison. The light control signal may be used to illuminate a light while a speaker produces music from the musical signals.

Yet another aspect of the present invention provides a device for producing light enhanced sound from digital musical signals on at least a first and second channel. The device includes means for reading the most significant bit (MSB) in each channel. The device also includes means for comparing the MSB from each channel and for generating red, green, and blue light control signals responsive to the comparison. The light control signal may be used to illuminate a light while a speaker produces music from the musical signals.

The present invention provides several technical advantages. One technical advantage of the present invention is that it adds stereoscopic enhancement to stereophonic sound to dramatize the empathy conveyed by the music creating a psychological moment between light impulses and sound, thus increasing the pleasure of the music. The dynamic photic driving produced by the present invention over the total brainwave frequency range may cause an increase in blood-flow rate to the brain without a corresponding increase in respiration rate. This induces relaxation and a sense of well-being in the user as well as a heightened appreciation of the music.

Another technical advantage of the present invention is that it provides a high degree of correlation between visual expression and sound impressions.

Yet another technical advantage of one embodiment of the present invention is that it provides a compact design of a headset having an electro-optical visor and speaker system. Both the visor and headset are adjustable for custom fitting to a user.

An additional technical advantage of the present invention is that it is suitable for use with many music sources including for example, but not limited to, compact disk (CD) players, FM stereo, and many other sources of binaural stereophonic, or quadraphonic sound.

Another technical advantage of the present invention is that it may be used to generate color on a computer display that correlates to music from a digital musical source.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein.

DETAILED DESCRIPTION OF THE INVENTION

Preferred embodiments of the present invention are illustrated in the FIGUREs, like numerals being used to refer to like and corresponding parts of the various drawings.

In stereophonic sound the signals heard in the listener's left and right ears have a phase difference proportional to a direction vector in three-dimensional space. Changes in time provide the perception of sound in motion that becomes the essence of music when the signals have specific relationships with one another.

In accordance with the present invention, light enhanced sound is achieved by emitting light when there is a phase difference between stereophonic channels. Light enhanced sound in accordance with the present invention is achieved by simultaneously strobing the human eyes with a light impulsing at the phase difference coherent with and derived from the music signals heard by the listener. Frequency division of the signals provides a derivative that reduces the frequency of photopic evoked potentials for driving light sources to the range of brainwave rhythms. Frequency division also has an effect similar to periods of silence alternating with periods of sounds. Wavelets, which compliment the sound, provide light impulses to emphasize the sounds and the periods of silence.

The present invention produces light enhanced sound by detecting the time-axis-crossing of sound signals in each stereo graphic channel, thus making the signals independent of amplitude variations. The present invention may also divide those signals to reduce their bandwidth and provide a derivative of the original signals for each channel. The present invention detects the phase difference between the stereo channels as a vector to drive a light emitting source. Stereophonic signals processed in this manner provide photic driving capability when the stereo signals have different phases. These photic driving signals are at brainwave frequencies and are used to drive light sources while the user simultaneously listens to the original unaltered stereophonic music thereby providing light enhanced sound.

Figure 1:
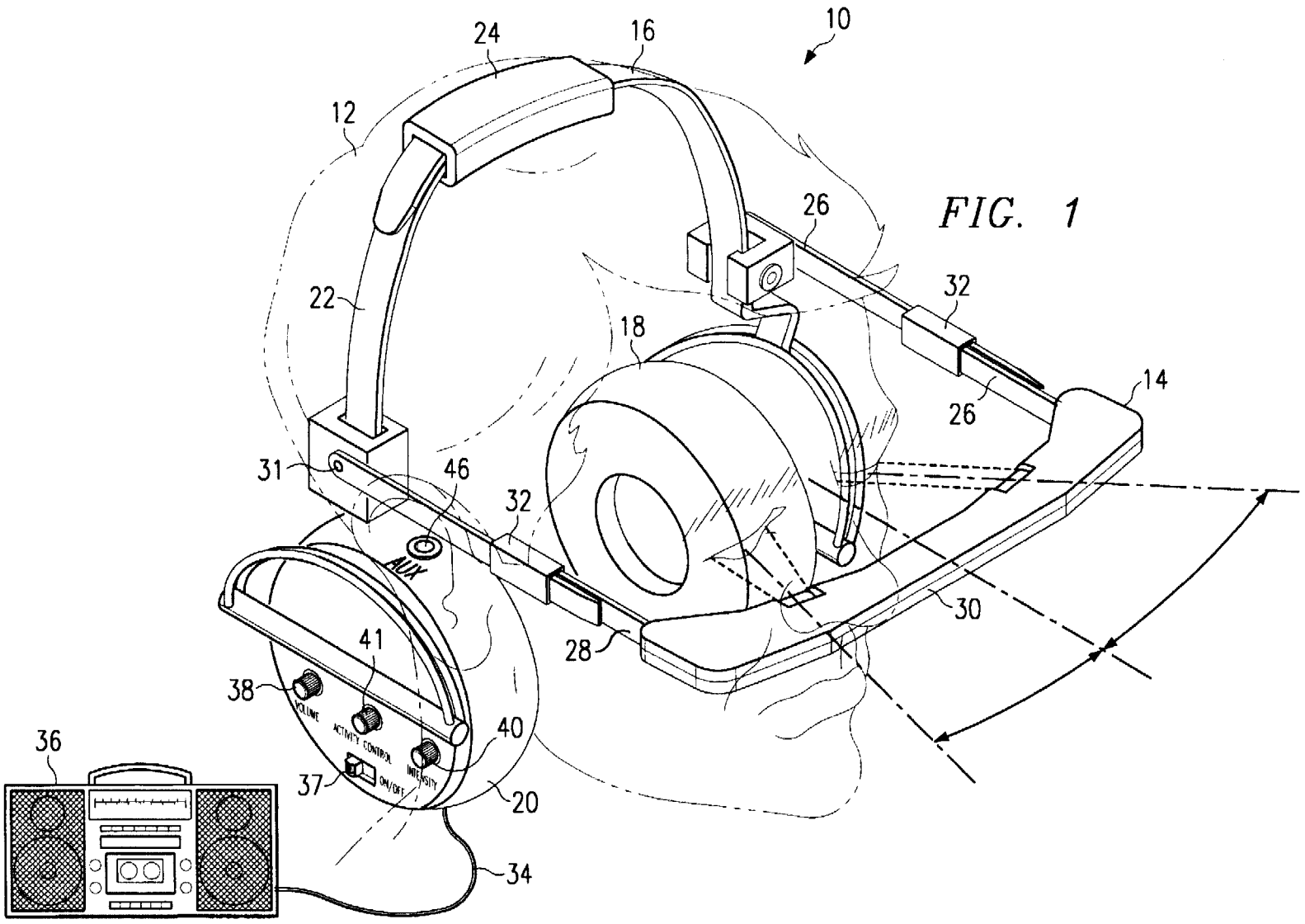
FIG. 1 shows an exemplary embodiment in perspective of one embodiment of a light enhanced sound device in accordance with the present invention.

FIG. 1 illustrates light enhanced sound device 10 embodying concepts of the present invention in use by person 12. Device 10 includes visor 14 and headset 16. Headset 16 includes left speaker 18 and right speaker 20. Speakers 18 and 20 are supported and separated by headband bracket 22 having adjustment mechanism 24 for sizing headset 16 as necessary to fit the user's head. Speakers 18 and 20 may be embodied in many commercially available headset speakers typically used for private listening enjoyment of music.

Visor 14 includes left visor arm 26 and right visor arm 28 coupled to headset 16. Visor arms 26 and 28 support light section 30 of visor 14. Visor arms 26 and 28 may be moved with respect to headset 16 at pivot joint 31. Additionally, each arm includes adjustment mechanism 32 for adjusting the length of respective arms 26 and 28. This allows visor 14 to be adjusted by person 12 as desired.

Light enhanced sound device 10 of the present invention also preferably includes connecting cable 34 for connecting to music source 36. Music source 36 may be many types of devices capable of reproducing musical signals from a music source including, but not limited to, a stereophonic player such as a CD player, FM radio, or many other binaural music sources. Music source 36 generally produces musical signals on at least two channels.

Light enhanced sound device 10 also preferably includes on/off switch 37, volume control 38, light intensity control 40, and activity control 41. On/off switch 37 turns device 10 on and off. Volume control 18 controls the amplitude of the music produced by left speaker 18 and right speaker 20 of device 10. It is noted that a separate volume control 18 may be provided for each speaker without departing from the spirit and scope of the present invention.

Figure 2:
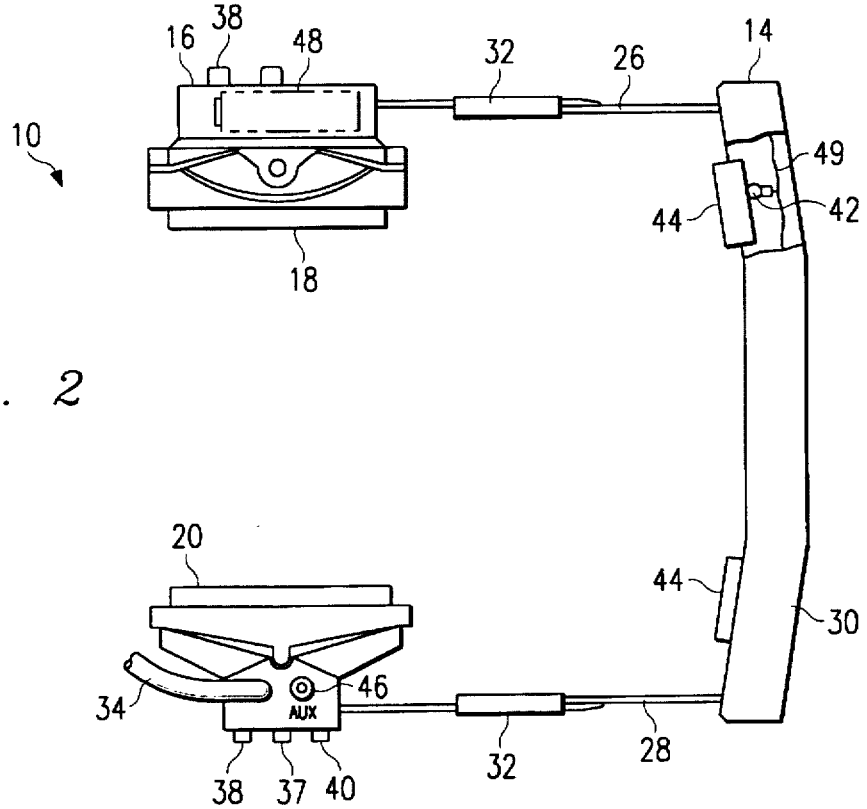
FIG. 2 provides a top-view of the light enhanced sound device of FIG. 1.

Intensity control 40 controls the magnitude of the light emitted by light section 30 of visor 14, which will be further described in discussions relating to FIG. 2. Activity control 41 sets the amount of flicker provided by light section 30 and will be described in discussions relating to FIG. 2. It is noted that on/off switch 37, volume control 38, light intensity control 40, and activity control 41 are not limited to the embodiments shown in FIG. 1 as other embodiments may be used without departing from the spirit and scope of the present invention.

FIG. 1 also shows auxiliary output 46 that may be used to connect a second light enhanced sound device 10 via connecting cable 34 so that a pair of devices can share a single music source 36.

FIG. 2 shows a top-view of light enhanced sound device 10 of FIG. 1. FIG. 2 shows additional detail on light section 30. Light section 30 generally includes one or more light sources 42 for generating light. Light section 30 also includes lens 44 directed toward the eyes of the user of device 10 and each light source 42. In one embodiment of the present invention, light source 42 may be a light emitting diode (LED), and a red LED has been found to be suitable. It is noted that in the view of FIG. 2 only one light source 42 has been shown exposed in light section 30. Preferably a second light source is positioned with respect to the other eye of a person using device 10. Lenses 44 in light section 30 may have many suitable characteristics and shapes and a cylindrical lens that spreads the light into a horizontal "eye" pattern made of a plastic material has been found to be suitable in one embodiment of the present invention.

Light source 42 couples to power source 48 in headset 16 by wire 49. In one embodiment of the present invention, power source 48 is a battery, e.g., standard AA cell. Alternatively, power source 48 could be replaced with an electrical connector for connection to standard power sources, e.g., 60 Hz power source. In this alternate embodiment, power source 48 requires circuitry to convert the 60 Hz power to appropriate direct current (DC) format for use by lighting source 42. Wire 49 between light source 42 and power source 48 may be contained within or external to arm 26. Additionally, wire 49 and light source 42 may be replaced with fiber optics. In this alternative embodiment of the present invention, light applied to lens 44 would be provided to lens 42 by the fiber optics.

In operation of light enhanced sound device 10 of FIGS. 1 and 2, person 12 positions device 10 over his or her head and adjusts headset 16 with adjusting mechanism 24 so that left speaker 18 and right speaker 20 are comfortably positioned proximal the ears of person 12. Also, person 12 may ad-just visor 14 with arm adjustment mechanisms 32 so that light section 30 is positioned directly in front of the person's eyes.

Once light enhanced sound device 10 is connected to music source 36 the music will be provided by speakers 18 and 20 to the person's ears. Light sources 42 in visor 14 will flash light visible by the person with or without his or her eyes closed. As previously described, the phase difference of the music on the left channel and right channel from music source 36 is used to generate a phase vector at the brainwave frequencies coherent with and generated from the phase differences of the stereophonic channels. This phase vector is used to drive light sources 42 with a "flickering" or "pulsing" effect. This pulsing of light sources 42 at the phase difference between the music channels provides aesthetic and entertaining light pulses viewed by person 12. This combination of light and sound from device 10 provides light enhanced sound to person 12.

Figure 3:
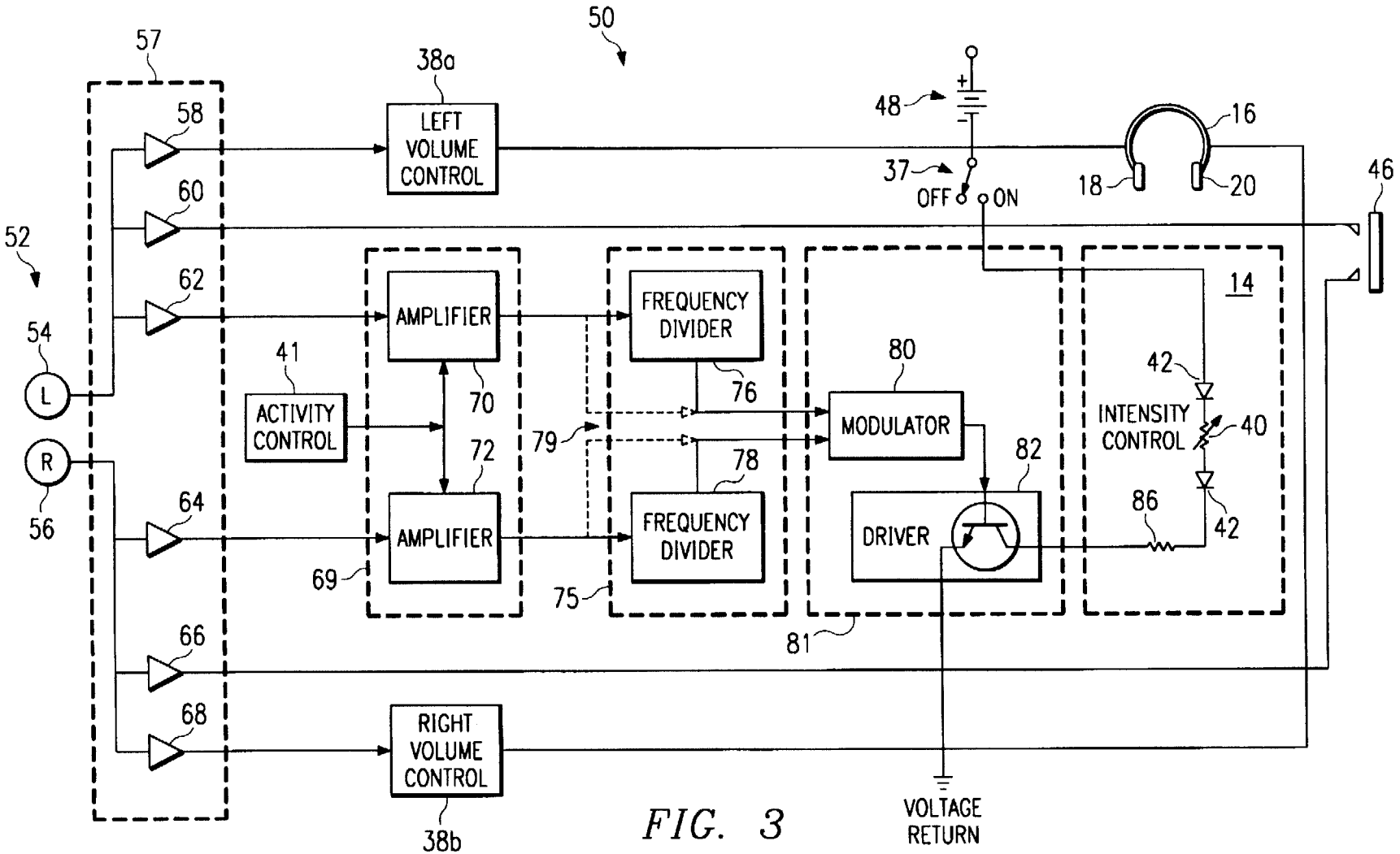
FIG. 3 illustrates an exemplary functional block diagram for one embodiment of the light enhanced sound device of the present invention.

FIG. 3 is an exemplary schematic block diagram of one embodiment for electronics 50 of light enhanced sound device 10 of the present invention. Electronics 50 are generally positioned within portions of headset 16 and visor 14 to provide light enhanced sound. At input 52 of electronics 50, which generally couples to connecting cable 34, are left channel 54 and right channel 56 inputs from a music source, such as music source 36 shown in FIG. 1. Channels 54 and 56 couple to isolation circuitry 57 for isolating the remainder of circuitry 50 from input 52. In one embodiment of the present invention, isolation circuitry 57 comprises six isolation amplifiers with left channel 54 coupling to isolation amplifiers 58, 60, and 62, and right channel 56 coupling to isolation amplifiers 64, 66, and 68. Isolation amplifiers 58 through 68 are preferably unity gain high-input impedance amplifiers that isolate input 52 from electronics 50 of light enhanced sound device 10.

In one embodiment of electronics 50, the output of isolation amplifier 58 couples to left volume control 38*a*, which may be, for example, a variable resistor. Left volume control 38*a*, in turn, couples to left speaker 18 of headset 16. Isolation amplifier 58 and left volume control 38*a* provide a means for adjusting the volume level of the music generated by left speaker 18. In a similar manner, isolation amplifier 68 and right volume control 38*b* control the volume level of the music at right speaker 20 of headset 16. It is noted that volume controls 38*a* and 38*b* may be embodied in a single volume control or as separate volume controls as illustrated in FIG. 3.

Isolation amplifier 60 and isolation amplifier 66 in isolation circuitry 57 couple to left channel 54 and right channel 56, respectively, and provide auxiliary output 46. With auxiliary output 46 two or more light enhanced devices of the present invention may simultaneously use a single music source.

Also within isolation circuitry 57, isolation amplifier 62 couples to left channel 54 at its input and couples to axis-crossing detection circuitry 69 at its output. Similarly, isolation amplifier 64 couples to right channel 56 at its input and couples to axis-crossing detection circuitry 69 at its output. In one embodiment of electronics 50, axis-crossing detection circuitry 69 comprises one or more saturation amplifiers. In the embodiment of axis-crossing detection circuitry 69 shown in FIG. 3, circuitry 69 contains saturation amplifier 70 that couples to the output of isolation amplifier 62 and saturation amplifier 72 that couples to isolation amplifier 64.

Axis-crossing detection circuitry 69 detects when the signals on left channel 54 and right channel 56 cross the time-axis and generates an axis-crossing signal at its output (s). Amplifiers 70 and 72 may be embodied in transimpedance amplifiers. Amplifiers 70 and 72 detect the time-access crossing at the mid range value of the amplitude variations in the signals in the right and left channels and provide a quasi-analog-to-digital conversion of these signals that are the axis-crossing signals from circuitry 69. When the music signal is crossing the time-axis, amplifiers 70 and 72 produce a logical "1" voltage level signal when the voltage transient is from a low level to a high level. Conversely, amplifiers 70 and 72 produce a logical "0" voltage level signal when the voltage transient is from a high level to a low level. The output of amplifier 70 and 72 are at logic voltage levels for use in remainder of circuitry 50. The outputs of amplifiers 70 and 72 at saturation provide corresponding logic-level signals representative of the music signal crossing the axis. As the music signal crosses back and forth across the time axis, saturation amplifiers 70 and 72 provide output signals representative of these occurrences.

Activity control 41 couples to axis-crossing detection circuitry 69 and adjusts the gain of saturation amplifiers 70 and 72 to provide a means to threshold the amplifier output levels in relation to the input of the remainder of electronics 50. Activity control 41 may be used to set the amount and frequency of light generated by light section 30 in response to the music. Activity control 41 may be used to set the gain of saturation amplifiers 70 and 72 to emphasize the signals of particular interest to the user of light enhanced sound device 10. For example, if a user wishes to emphasize low frequency, low power signals then activity control 41 may be used to set the gain of amplifiers 70 and 72 high so as to emphasize these signals. Conversely, if a user wishes to give dominance to high frequency signals, then activity control 41 may be used to set the gain of amplifiers 70 and 72 low in axis-crossing detection circuitry 69 so that the high frequency signals are emphasized with respect to the low frequency signals. In one embodiment of the present invention, light activity control 41 is a transimpedance amplifier.

The output of axis-crossing detection circuitry 69 may be used to drive frequency division circuitry 75. Frequency division circuitry 75 may be used to reduce the bandwidth of the signals from axis-crossing detection circuitry, as well as to reduce the frequency of these signals while maintaining the phase difference between the signals. By dividing the original signals by, for example 2 or 4, a first or second derivative of the original musical signals may be used to control the amount of flicker of the lights in the visor. This may be used to reduce the flicker rate so that motion is perceived by the user, noting that motion is typically detected at frame rates less than 30 Hz. In one embodiment of frequency division circuitry 75 of the present invention, separate frequency dividers are provided with frequency divider 76 coupling to saturation amplifier 70 in axis-crossing detection circuitry 69 and frequency divider 78 coupling to saturation amplifier 72 in axis-crossing detection circuitry 69.

In one embodiment of the present invention, bypass 79 is provided as a direct path from axis-crossing detection circuitry 69 to light control circuitry 81. Electronics 50 also includes light control circuitry 81 that generates a light signal that controls when the light sources in the light section of device 10 are lit in response to the phase difference of the musical signals in the left 54 and right 56 channels. One embodiment of light control circuitry 81 of the present invention includes modulator 80 and driver 82. Modulator 80 accepts the outputs of frequency division circuitry 75 or axis-crossing detection circuitry 69 to detect when there is a phase difference between the signals on left channel 54 and right channel 56. Modulator 80 does so by monitoring whether both channels are crossing the time-axis at the same instant. If both channels cross the time-axis at the same instant then the signals are in-phase and no light is generated. If, however, only one channel is crossing the time-axis at any instant then the signals are not in phase and light is generated.

In one embodiment of the present invention modulator 80 is an exclusive or gate that receives the logic-level outputs of axis-crossing detection circuitry 69 or frequency division circuitry 75 to provide an output only when the frequencies of the two signals, i.e., phase, are different. Modulator 80 couples to driver 82 which drives visor circuitry 84. In one embodiment of the present invention, driver 82 is the open-collector output of an exclusive or gate that is part of modulator 80. Therefore, devices 80 and 82 may be part of a single device.

Visor circuitry 84 in electronics 50 includes LEDs 42 as previously described in discussions relating to FIG. 2 as well as current limiting resistor 86 to limit the current to LEDs 42. Visor circuitry 84 may also include intensity control 40, which may be embodied in a variable resistor, for setting the intensity or brightness of the light emitted by LEDs 42. Visor circuitry 84 also couples to power source 48 that provides power to visor circuitry 84.

Figure 4:
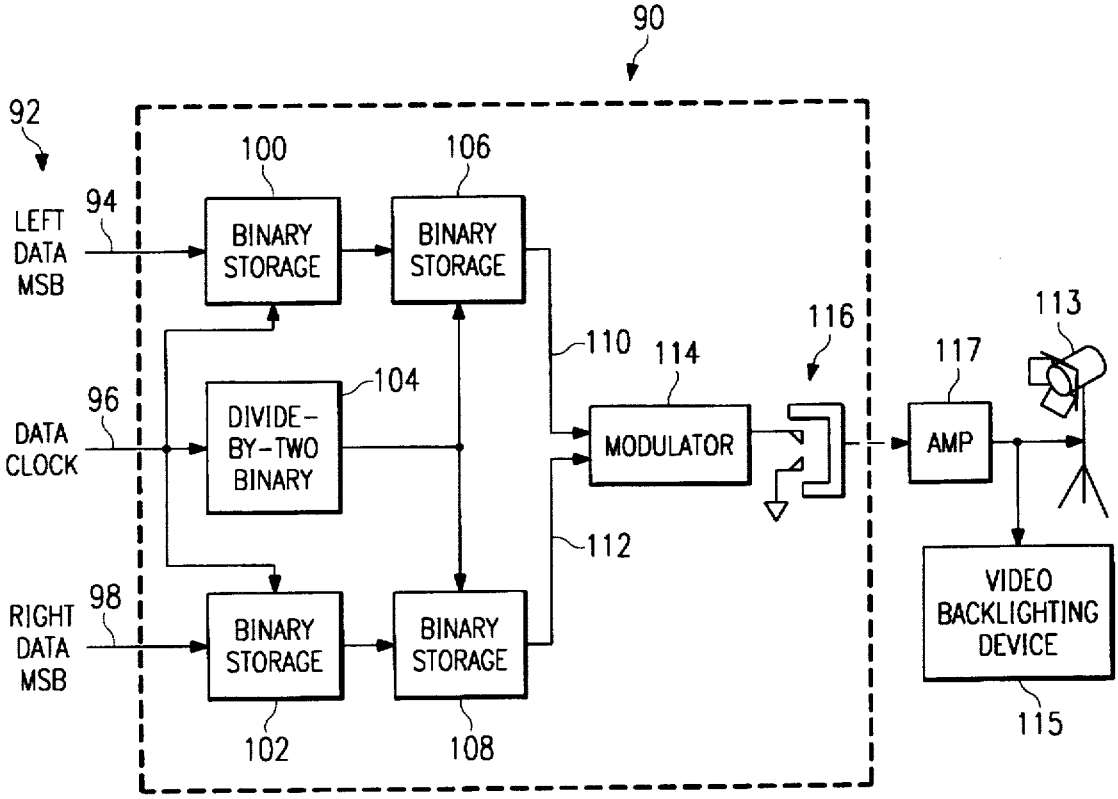
FIG. 4 illustrates a functional block diagram for another embodiment of the present invention for producing light enhanced sound from a digital musical source.

FIG. 4 shows another embodiment of the present invention to provide light enhanced sound that is particularly suitable for sound stored in a digital format, e.g., CD or produced by a musical instrument equipped with a musical instrument digital interface (MIDI). Circuitry 90 is preferably part of the music source, i.e., in a CD player. Circuity 90 in FIG. 4 includes input 92 having left data most significant bit (MSB) input 94, data clock 96, and right data MSB input 98 for receiving the music in digital form. The MSB may also be referred to as a mid-range bit or sign-bit. Circuitry 90 includes binary storage 100 that couples to left data MSB input 94 and binary storage 102 that couples to right data MSB input 98. Binary storage 100 and binary storage 102 stores the MSB or axis-crossing bit. Data clock 96 couples to binary storage 100 and 102 to provide a timing reference for the data bits at inputs 94 and 98. These bits may be used for phase difference detection and input to modulator 114 to drive a visor. Alternatively, the derivatives of these MSBs may be obtained with binary division. The circuitry of FIG. 4 may be expanded to division to "N" derivatives using a simple clock divided by "N."

In order to perform binary division on these MSBs, divide-by-two binary circuitry 104 divides the clock signal at data clock 96 by an appropriate amount and couples to binary storage 106 and binary storage 108. Binary storage 106 couples to binary storage 100 while binary storage 108 couples to binary storage 102. Binary storage 106 and binary storage 108 each couple to divide by two binary circuitry 104 that provides on its output the clock frequency divided by two. Binary storage 106 receives the most significant bit from binary storage 100 and the divided clock signal to generate a derivative signal as left channel derivative 110. In similar manner, binary storage 108 provides right channel derivative 112. These derivatives correspond to every other most significant bit in left data input 94 and right data input 98.

Modulator 114 couples to left channel derivative 110 and right channel derivative 112 or directly to binary storage 100 and 102 when derivatives are not used. Modulator 114 provides an output when the MSB's or their derivatives are logically unalike "or" the low level output when the derivatives are alike, which is by definition phase detection. The output from modulator 114 may be provided to visor 14 via visor input 116 in, for example a monaural output jack to drive the lights in the visor as previously described in discussions relating to FIGS. 2 and 3. Alternatively, the output of circuitry 90 may be used to drive many types of lighting sources. For example, circuity 90 may be used to drive stage lighting 113 or backlighting for video recording. These systems can deliver lighting of varying color and intensity that is derived from the music. Such systems can deliver light enhanced sound in accordance with the present invention to both live and video-recorded performances. Additional details on this aspect of the present invention will be described in discussions relating to FIG. 5 hereinafter. It is noted that the present invention is not limited to these above-mentioned embodiments as the present invention may be used to produce light enhanced sound in many applications.

The binary frequency division in each channel may be implemented in several different ways. In one embodiment of the present invention a derivative to exclude every other data bit reducing the frequency and bandwidth by one-half may be employed or the derivative may be generated by detecting the leading edge (either a positive or negative transition between logic one and zero levels) in toggling a binary storage unit such as a type D or type JK flip flop.

Additionally, it is noted that circuitry 90 in FIG. 4 may be in headset 16 without departing from the spirit and scope of the present invention. In this embodiment, the electronics in headset 16 receive the digital MSB directly from the CD player or other digital music source and processes the MSBs in a similar manner as described with respect to circuitry 90 in FIG. 4.

Figure 5:
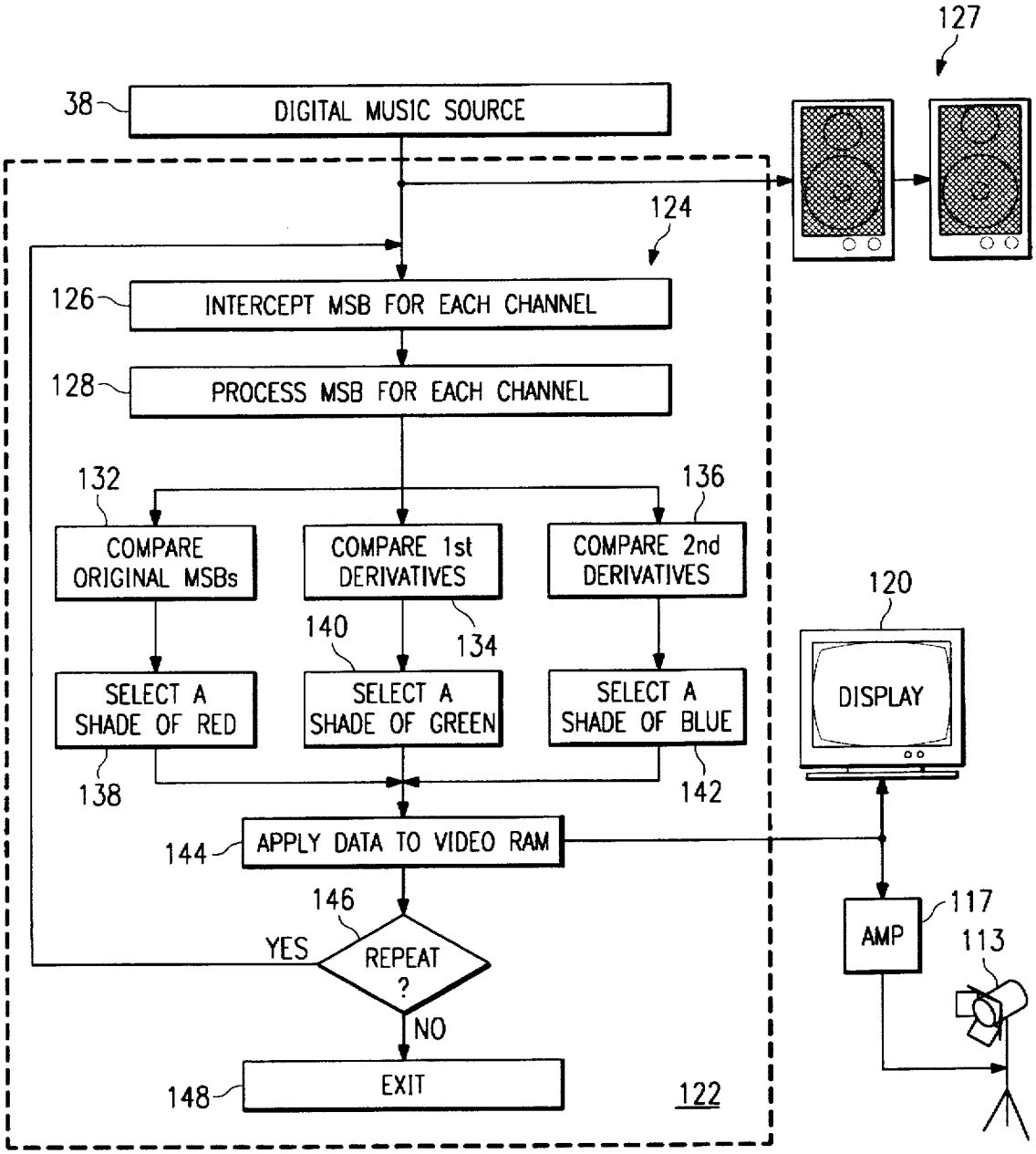
FIG. 5 is a combination functional block diagram and flowchart of another embodiment of the present invention for providing light enhanced sound to a display in accordance with the present invention.

Another embodiment of the present invention is illustrated in FIG. 5. This embodiment of the present invention provides a means by where the concepts of the present invention for generating light enhanced sound are used to set the colors of computer display 120. Musical source 38 couples to computer 122, which may be a standard personal computer(PC). Alternatively, music source 38 may be incorporated into PC 122, e.g., CD-ROM player or MIDI. Software within computer 122 implements the present invention to provide appropriate colors for display 120.

The steps of the present invention within computer 122 that may be implemented in software are represented by flowchart 124 in FIG. 5. At step 126, the MSB from each of the right channel and left channel output from digital music source 38 is intercepted. These data bits may be intercepted, for example, as they are provided to the digital-to-analog conversion circuits in PC 122 that produce stereophonic sound in computer 122, such as a sound card. The sound card, in turn, produces the music at speakers 127. Next, at step 128 the left and right channels are processed by storing the MSB bit for each channel. Alteratively, at step 128, the second or fourth transition of the MSB changing logic levels in the same direction, e.g., low to high, as they occur in time, such as, every other MSB in the time domain, may be stored as the first derivative. The number of derivatives may be increased as desired.

Proceeding from step 128 the present invention proceeds in parallel on three paths. At step 132 a comparison is made between the original most significant bits between the left and right channels. This may be accomplished, with for example, an exclusive or gate. In parallel, at step 134 the first derivative of the left and right channel are similarly compared. At step 136 the second derivatives are compared. When a difference exists between the left and right channels at step 132, 134, and 136, an output is generated to drive a color or computer display 120. The output of step 132 may be display a color of red. Additionally, at step 138, a user may pick the shade of red (hue) with, for example, a digital to analog converter color palette. In a similar manner, the output from step 134 is used at step 140 to select a shade of green (hue), and at step 142 the output from step 136 is used to select a shade of blue (hue). At step 144 the outputs from step 138, 140, and 142 are applied to a video ram. This data may be used to rasterscan a custom bit map on display 120. Alternatively, this data may be used to drive stage lighting 113 or backlighting for video recording with amplifier 117 as previously described in discussions relating to FIG. 4. Moving pictures experts group (MPEG) algorithms may be used in connection with standard stereophonic music sources to generate light enhanced sound in an image's background.

From step 144 a query is made at step 146 as to whether additional inputs have been received. If the answer is yes, then the flow returns back to step 126. If the music has ended, flowchart 126 ends at step 148. By the method shown and described in FIG. 5, the present invention can be used to drive the colors on a standard computer display. By setting the colors in accordance with the phase difference of the music applied to or supplied by computer 122, a visually relaxing scene is produced on display 120 corresponding to the music being heard by the user of the computer. Such a system helps relax the user while watching light enhanced music provided by computer 120.

Although the present invention has been described in detail, it should be understood that various changes, substitutions, and alterations can be made hereto without departing from the spirit and scope of the invention as defined by the appended claims.

What is claimed is:

1. A device for producing light enhanced sound from a stereophonic music source producing music signals on at least a first channel and a second channel, the device comprising:

an axis-crossing detection circuitry operable to detect when the music signal on each channel crosses the time-axis, to initiate a transition in a first axis-crossing detection signal when an axis-crossing is detected in the music signal of the first channel, and to initiate a transition in a second axis-crossing detection signal when an axis-crossing is detected in the music signal of the second channel;

a light control circuitry operable to enable a light signal for a period of time that corresponds to a phase difference between the music signal of the first channel and the music signal of the second channel and that corresponds to a phase difference between the first axis-crossing detection signal and the second axis-crossing detection signal, wherein the light signal is generated for certain periods at a flicker rate below 50 Hz; and a light operable to illuminate in response to the light signal.

2. The device of claim 1, wherein the speaker further comprises:

a first speaker coupled to the first channel; and a second speaker coupled to the second channel.

3. The devices of claim 1, wherein the light further comprises a first and second light each responsive to the light signal.

4. The device of claim 1, further comprising:

a frequency divider circuitry operable to reduce the frequency of the first axis-crossing detection signal to generate a first frequency divided signal, and operable to reduce the frequency of the second axis-crossing detection signal to generate a second frequency divided signal, wherein the light control circuitry is operable to enable the light signal in response to the first frequency divided signal and the second frequency divided signal.

5. The device of claim 4, wherein the frequency divider circuitry includes a divide by N circuit.

6. The device of claim 4, wherein the light control circuitry includes a modulator operable to enable the light signal in response to the first frequency divided signal and the second frequency divided signal.

7. The device of claim 4, wherein the frequency divider circuitry reduces the frequency of the first axis-crossing detection signal and the second axis-crossing detection signal by about the same amount.

8. The device of claim 1, further comprising:

a frequency divider circuitry coupled between the axis-crossing detection circuitry and the light control circuitry for generating a derivative of the first axis-crossing detection signal and the second axis-crossing detection signal for use by the light control circuitry in enabling the light signal.

9. The device of claim 1, further comprising an activity control for adjusting the gain of the music signal.

10. The device of claim 9, wherein the axis-crossing detection circuitry includes a variable gain amplifier whose gain is controlled by the activity control.

11. The device of claim 1, wherein the music signals are analog signals.

12. The devices of claim 1, wherein the light is a stage lighting.

13. The device of claim 1, wherein the light is a video backlighting device.

14. The device of claim 1, wherein the music signals are digital signals.

15. The device of claim 14, wherein the axis-crossing detection circuitry is further operable to read the most significant bit (MSB) of the digital music signal of the first channel and to initiate a transition in the first axis-crossing detection signal when the MSB of the digital music signal of the first channel transitions, and to read the MSB of the digital music signal of the second channel and to initiate a transition in the second axis-crossing detection signal when the MSB of the digital music signal of the second channel transitions.

16. The device of claim 15, wherein the light is one of a stage lighting and a video backlighting device.

17. The device of claim 15, wherein the light control circuitry includes a modulator operable to enable the light signal in response to the first axis-crossing detection signal and the second axis-crossing detection signal.

18. The device of claim 15, wherein the MSB of the digital music signal of the first channel is the first axis-crossing detection signal and the MSB of the digital music signal of the second channel is the second axis-crossing detection signal.

19. The device of claim 18, wherein the light control circuitry includes a modulator that compares the MSB of the digital music signal of the first channel to the MSB of the digital music signal of the second channel and generates the light signal in response.

20. The device of claim 15, further comprising:

a frequency divider circuitry operable to reduce the frequency of the first axis-crossing detection signal to generate a first frequency divided signal, and operable to reduce the frequency of the second axis-crossing detection signal to generate a second frequency divided signal, wherein the light control circuitry is operable to enable the light signal in response to the first frequency divided signal and the second frequency divided signal.

21. The device of claim 14, wherein:

the axis-crossing detection circuitry is further operable to intercept the most significant bit (MSB) in each digital music signal of each channel; and the light control circuitry further operable to generate light signals related to transitions in the MSBs in each signal of each channel to control the generation of red, green, and blue light signals.

22. The device of claim 21, wherein the light is one of a display, a stage light, and video backlighting device.

23. The device of claim 1, wherein the stereophonic music source is a coherent music sources.

24. The device of claim 1, wherein a user of the device will detect an illuminated light from the light before the corresponding portion of the music signals are heard by the user.

25. The device of claim 1, wherein the phase difference between the first axis-crossing detection signal and the second axis-crossing detection signal is independent of near-balanced amplitude variations between the music signal of the first channel and the music signal of the second channel.

26. The device of claim 1, wherein the light control circuitry includes a modulator operable to enable the light signal in response to the first axis-crossing detection signal and the second axis-crossing detection signal.

27. The device of claim 26, wherein the modulator provides an Exclusive-OR function.

28. The device of claim 1, wherein the first axis-crossing detection signal and the second axis-crossing detection signal are quasi-digital signals.

29. The device of claim 1, wherein the first axis-crossing detection signal and the second axis-crossing detection signal are digital signals.

30. A device for producing light enhanced sound from a stereophonic music source producing music signals on at least a first and second channel, the device comprising:

a headset comprising:

a speaker for reproducing music from the music signals;

an axis-crossing detection circuitry operable to detect when the music signal on each channel crosses the time-axis, to initiate a transition in a first axis-crossing detection signal when an axis-crossing is detected in the music signal of the first channel, and to initiate a transition in a second axis-crossing detection signal when an axis-crossing is detected in the music signal of the second channel a light control circuitry operable to enable a light signal for a period of time that corresponds to a phase difference between the first axis-crossing detection signal and the second axis-crossing detection signal, wherein the light signal is generated for certain periods at a flicker rate below 50 Hz; and a visor coupled to the headset comprising:

a light operable to illuminate in response to the light signal.

31. The device of claim 30 wherein the speaker further comprises:

a first speaker coupled to the first channel; and a second speaker coupled to the second channel.

32. The device of claim 30, wherein the light further comprises a first and second light each responsive to the light signal.

33. The device of claim 30, further comprising:

a frequency divider circuitry operable to reduce the frequency of the first axis-crossing detection signal to generate a first frequency divided signal, and operable to reduce the frequency of the second axis-crossing detection signal to generate a second frequency divided signal, wherein the light control circuitry is operable to enable the light signal in response to the first frequency divided signal and the second frequency divided signal.

34. The device of claim 30, further comprising:

a frequency divider circuitry coupled between the axis-crossing detection circuitry and the light control circuitry for generating a derivative of the first axis-crossing detection signal and the second axis-crossing detection signal for use by the light control circuitry in enabling the light signal.

35. The device of claim 30, further comprising an activity control for adjusting the gain of the music signal.

36. The device of claim 30, wherein the visor further comprises:

a lens operable to produce a horizontal eye light pattern from the light illuminated from the light.

37. The device of claim 36, wherein the horizontal eye light pattern is sized to cover about the area of a closed eye.

38. The device of claim 30, wherein the music signals are digital signals.

39. The device of claim 30, wherein the music signals are analog signals.

40. A method for generating light enhanced sound from a stereophonic music source producing music signals on at least a first and a second channel, the method comprising:

detecting when the music signal on each channel crosses the time-axis;

generating a first axis-crossing detection signal that transitions when an axis-crossing is detected in the music signal of the first channel generating a second axis-crossing detection signal that transitions when an axis-crossing is detected in the music signal of the second channel;

generating a light signal that is enabled for a period of time that corresponds to a phase difference between the first axis-crossing detection signal and the second axis-crossing detection signal, wherein the light signal is Generated for certain periods at a flicker rate below 50 Hz; and illuminating a light in response to the light signal.

41. The method of claim 40, further comprising:

reproducing music from the music signals at a first speaker.

42. The method of claim 40, wherein illuminating a light further comprises:

illuminating a first and a second light responsive to the light signal.

43. The method of claim 40, further comprising:

reducing the frequency of the first axis-crossing detection signal to generate a first frequency divided signal; and reducing the frequency of the second axis-crossing detection signal to generate a second frequency divided signal, wherein generating a light signal includes enabling the light signal in response to the first frequency divided signal and the second frequency divided signal.

44. The method of claim 40, further comprising:

generating a derivative of the first axis-crossing detection signal; and generating a derivative of the second axis-crossing detection signal, wherein the derivative of the first axis-crossing detection signal and the derivative of the second axis-crossing detection signal are used in generating the light signal.

45. The method of claim 40, further comprising:

adjusting the gain of the music signals.

46. The method of claim 40, wherein the music signals are digital signals.

47. The method of claim 40, wherein the music signals are analog signals.

* * * * *